United States Patent [19]

MacKenzie et al.

[11] 4,023,828

[45] May 17, 1977

[54] STABILIZER PAD FOR EARTHMOVING APPARATUS

[76] Inventors: Robert A. MacKenzie, 181 Morton St., Stoughton, Mass. 02072; Andry Lagsdin, Lot No. 4, King Hill Road, Hanover, Mass. 02339

[22] Filed: July 7, 1975

[21] Appl. No.: 593,699

Related U.S. Application Data

[63] Continuation-in-part of Ser. Nos. 342,684, March 19, 1973, Pat. No. 3,897,079, and Ser. No. 391,043, Aug. 24, 1973, Pat. No. 3,913,942.

[52] U.S. Cl. ..... 280/763; 280/764

[51] Int. Cl.[2] ..... B60S 9/02

[58] Field of Search ..... 280/150.5; 212/145; 182/111, 108, 109; 248/188.8, 357

[56] References Cited

UNITED STATES PATENTS

| | | | |
|---|---|---|---|
| 3,630,544 | 12/1971 | Grisham | 280/150.5 |
| 3,721,458 | 3/1973 | Mitchell | 280/150.5 |

FOREIGN PATENTS OR APPLICATIONS

| | | | |
|---|---|---|---|
| 492,912 | 5/1953 | Canada | 182/111 |

*Primary Examiner*—Robert R. Song
*Attorney, Agent, or Firm*—Wolf, Greenfield & Sacks

[57] ABSTRACT

A stabilizer pad for attachment to an arm of a piece of earthmoving equipment such as a backhoe. In one embodiment the pad has a solid geometric shape such as a cube or pyramid with at least three outer surfaces, any one of which can be arranged as a ground engaging surface. The pad or the arm has a cut-out section for permitting rotation of the pad relative to the arm to at least two different positions. In another embodiment the pad is pivotally secured to the arm. In one position the pad is positioned below the arm and in the other position the pad rotates about 180° with the end of the arm forming a grouser and the other side of the pad functioning to limit the penetration of the arm into the ground.

4 Claims, 9 Drawing Figures

FIG. 5
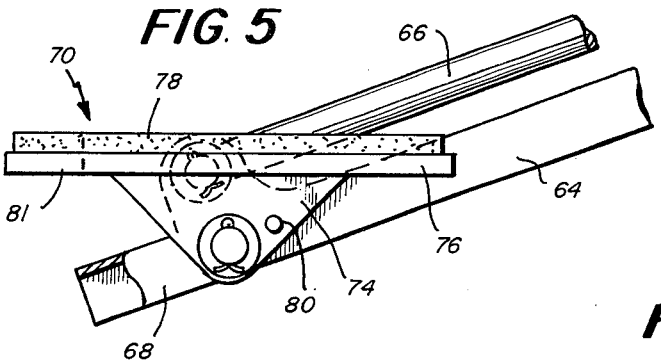
FIG. 6
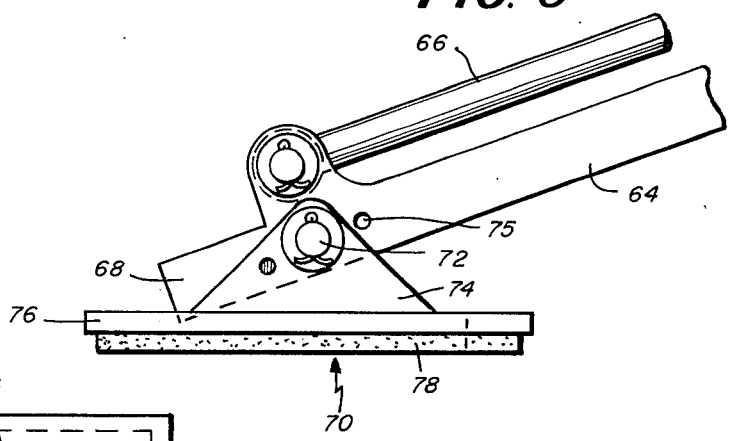
FIG. 7
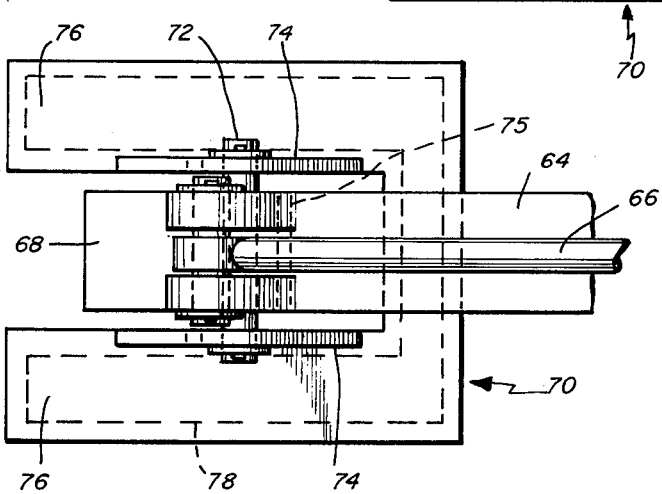
FIG. 8
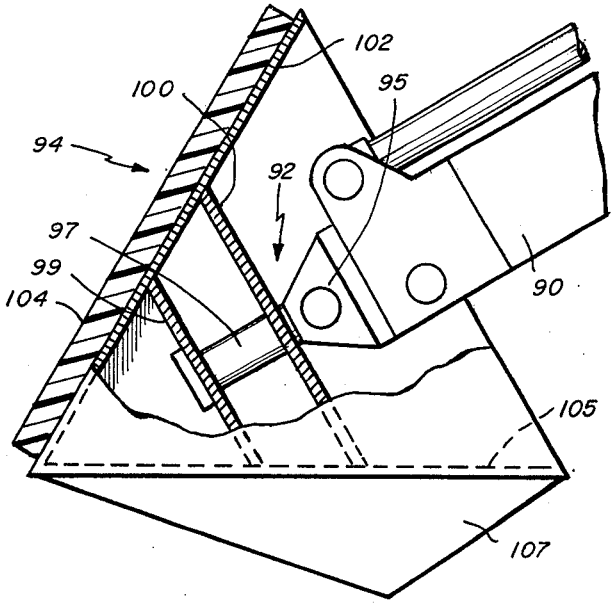
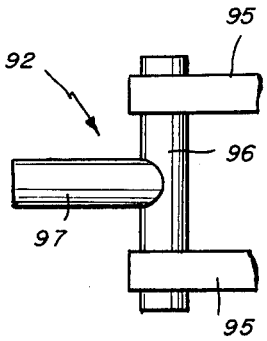
FIG. 9

STABILIZER PAD FOR EARTHMOVING APPARATUS

RELATED APPLICATIONS

This application is a continuation-in-part of Application Ser. No. 342,684 filed Mar. 19, 1973, now U.S. Pat. No. 3,897,079, and Application Ser. No. 391,043 filed Aug. 24, 1973, now U.S. Pat. No. 3,913,942.

BACKGROUND OF THE INVENTION

The present invention relates, in general, to a stabilizer pad for use with a piece of earthmoving equipment. More particularly, this invention is concerned with a reversible stabilizer pad that may be reversed to at least two opposite positions.

In our Application Ser. Nos. 342,684 and 391,043 there is disclosed a reversible pad that basically rotates through 180° between two opposite positions. It has been found that for some applications it may be advantageous to have the capability of using more than two terrain engaging surfaces. Accordingly, one object of the present invention is to provide a reversible pad that is preferably of solid geometric shape such as a cube or pyramid and having at least three outer surfaces, any one of which can be arranged as a ground engaging surface.

Another object of the present invention is to provide a reversible pad that need not be rotated through 180° between alternate positions but can be rotated through an angle smaller than 180°.

In accordance with another aspect of the present invention it is an object to provide a reversible pad that in one position functions in conjunction with the end of the support arm to form a ground engaging surface structure wherein the arm functions as a grouser. With this arrangement in an opposite position which may be disposed 180° from the first position, the pad rotates below the arm and the arm no longer functions in conjunction with the pad in this second position other than to support the pad.

Summary of the Invention

To accomplish the foregoing and other objects of the invention there is provided an improved stabilizer pad for earthmoving apparatus. A pair of these pads are used with a typical piece of equipment one being associated with each arm of the equipment. In one embodiment the pad is constructed having a solid geometric shape such as a cube or pyramid and the pad may either be hollow, partially hollow, or completely solid. Means are provided for pivotally revolving the pad relative to the arm. If the arm is of the typical straight type, then the pad may be cut-out so that the pad can revolve between at least two ground engaging surfaces. If the pad is of triangular cross-section then the revolution may be through an angle on the order of 120° to change from one position to the adjacent position. One of the ground engaging surfaces may be flanged and the other ground engaging surface may have a resilient means associated therewith such as for use on an asphalt pavement. In a slightly alternate embodiment, the arm may be bifurcated defining two legs for supporting the geometrically shaped pad therebetween. With this arrangement it is quite easy to provide revolution of the pad between three or even more ground engaging surfaces.

In accordance with another embodiment of the present invention the pad is substantially flat and has means for permitting pivotal securing of the pad to the arm of the equipment. The pad preferably has a resilient surface which is the ground engaging surface in a first position of the pad. The pad is preferably rotated through 180° to a second position wherein the arm end is disposed below the pad and functions in association with the pad. In this second position, the end of the arm forms a grouser itself and the pad is preferably locked in this position and functions in association with the arm end to limit the engagement of the arm with the ground.

BRIEF DESCRIPTION OF THE DRAWINGS

Numerous other objects, features and advantages of the invention should now become apparent upon a reading of the following detailed description taken in conjunction with the accompanying drawings, in which:

FIG. 5 shows still another embodiment in a side view with the pad in a first position;

FIG. 6 shows the same construction as shown in FIG. 5 but with the pad in a second position;

FIG. 7 is a top view of FIG. 5;

FIG. 8 is a side view partially cut-a-way of another embodiment of the invention; and FIG. 9 shows the interconnecting pin depicted in FIG. 8.

DETAILED DESCRIPTION

Figure 1:
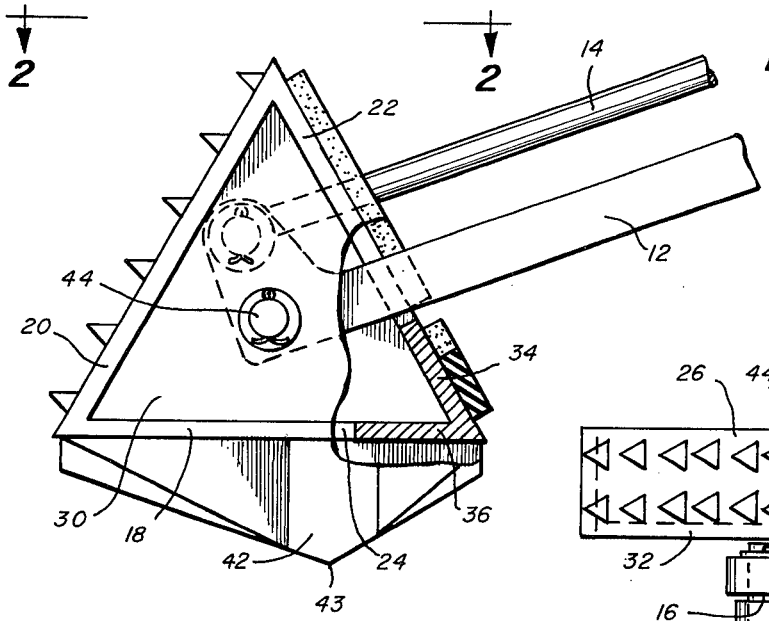
FIG. 1 shows one embodiment of the pad of this invention with the pad partially cut-a-way.
Figure 2:
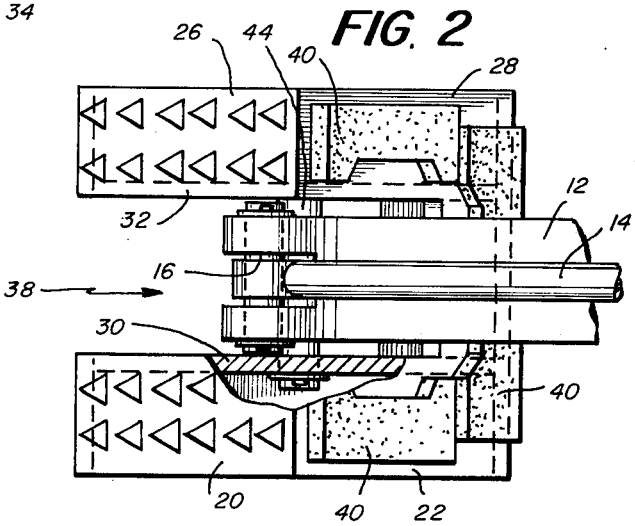
FIG. 2 is a top view taken along line 2—2 of FIG. 1 with a section of the pad cut-a-way.

FIGS. 1 and 2 show two different views for one embodiment of the pad of this invention. In this embodiment, the pad has an equilaterally triangular cross-section. The pad is secured to an arm 12 of the equipment. The arm 12 may have a lifting rod 14 associated therewith which couples by means of a pin 16 to the end of the arm. The lifting rod 14 may be operated hydraulically to lift the arm and its associated pad from contact with the ground.

The pad comprises walls 18, 20 and 22; like walls 24, 26 and 28; and triangular shaped upright walls 30 and 32. All of these walls may be interconnected by spot welding or other appropriate means. As indicated in FIG. 1 the walls 22 and 28 are interconnected by a wall segment 34 and the walls 18 and 24 are also interconnected by a wall segment 36. These two wall segments and the upright walls 30 and 32 define a slot 38 for accommodating the arm 12 as the pad is rotated between its different positions. With the arrangement shown in FIG. 1, only two of the three surfaces defined by the walls can be ground engaging surfaces. These two surfaces comprise a surface defined by walls 22 and 28 and the surface defined by walls 18 and 24. The walls 22 and 28 carry somewhat resilient pads 40 and this surface is primarily adapted for use on a hard surface such as an asphalt pavement.

The other surface defined by walls 24 and 30 and wall segment 36, has a flange structure 42 extending downwardly therefrom to a point 43. This ground engaging surface is primarily for use on a softer dirt surface.

The pad is secured to the arm by means of a pin 44 which extends through the wall 30 and 32. As shown in FIG. 1, the pin 44 may be secured at either end by a washer and cotter pin. The pin 44, of course, also extends through a lower end of the arm 12 as shown in FIG. 1 and thus the pad is relatively freely pivotal about the arm 12.

Figure 3:
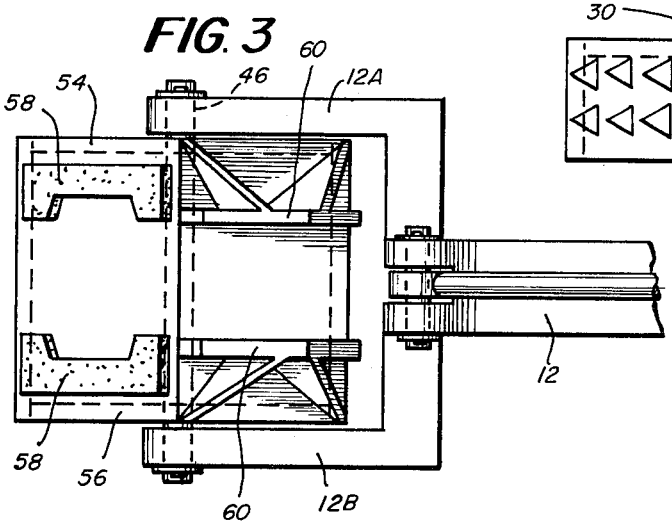
FIG. 3 is a top view of a second embodiment of the pad.
Figure 4:
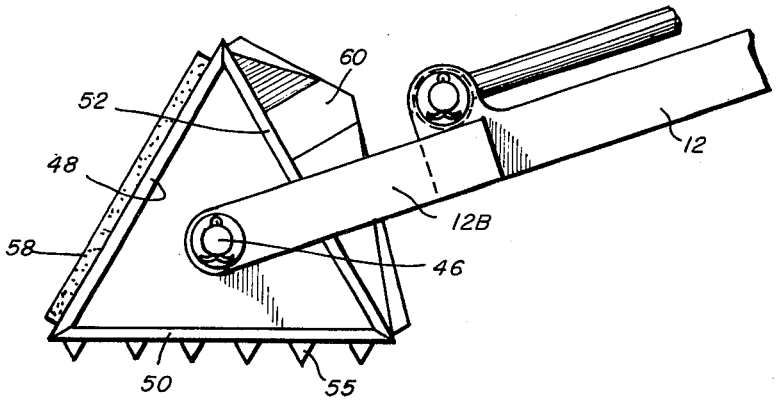
FIG. 4 shows a side view of the pad shown in FIG. 3.

FIGS. 3 and 4 show another embodiment of the invention which operates quite similarly to the one shown in FIGS. 1 and 2. In this embodiment the arm 12 has a bifurcated end defining legs 12A and 12B. The pad is disposed between these legs and is secured to the legs by means of a pin 46. Pin 46 is somewhat elongated and may be secured at either end by an arrangement similar to that shown in FIG. 1 including a washer and cotter pin at either end of the pin.

The pad comprises walls 48, 50 and 52 defining the generally triangular shape and end walls 54 and 56 which are of triangular shape. The embodiment shown in FIGS. 3 and 4 is hollow. However, this could be provided also in a solid shape. In the embodiments shown in FIGS. 3 and 4 the pad can be rotated completely around and thus any of the walls 48, 50 or 52 can be maintained as the horizontal wall. In FIG. 4, the wall 50 has cleats 55 which are used for ground engagement. The pad can be rotated to the other two positions so that the resilient pad 58 is engaging the ground or the flange 60 is engaging the ground.

In FIGS. 1–4 the pad has been shown as being of triangular shape. It is also contemplated that the pad could be of other shapes such as a cubic shape or a shape having a trapezoidal cross-section. Also, the pad may have four or more sides. The arrangement shown in FIGS. 3 and 4 is of particular interest in that there are three different ground engaging surfaces that can be used. The flange 60 may be used in very soft soil whereas the cleats 55 can be used for harder terrain.

FIGS. 5, 6 and 7 show another embodiment of this invention. The arm 64 has an operating rod 66 associated therewith and is like the arm 12 shown in FIG. 1 except that there is provided an extension 68 which may be of U-shape cross-section. This extension 68 forms a grouser when the pad 70 is in the position shown in FIG. 5. The pad 70 may be of the type shown in the first embodiment disclosed in our Application Ser. No. 342,684. Thus the pad 70 would be provided with a cut-out portion for permitting at least limited rotation of the pad relative to the arm 64.

The pad 70 is secured to the arm 64 by means of a pin 72 which passes through the arm 64 and also a pair of flanges 74 (only one shown in the drawings) which form a part of the pad 70. The pad 70 also comprises a flat plate 76 having a resilient pad 78 affixed thereto. In the position shown in FIG. 5, the pad 70 is locked in that position by means of pin 80 which passes through the flange 74 into an aperture 75 in the arm 64. The pin 80 may be secured in any well known manner at either end. In the position shown in FIG. 5 it can be seen that the extension 68 forms a grouser that functions as a flange for digging into the ground. In this position the bottom surface 81 of the plate 76 forms a limiting surface so that the extension 68 does not become buried in the ground to too great depth.

For use on harder surfaces such as an asphalt paving the pin 80 is removed and the pad 70 may be rotated to the position shown in FIG. 6. In this position the resilient pad 78 is in engagement with the ground and it is noted that the pad swings below the extension 68 so that this extension is not interferring with the operation of the pad in that position.

FIG. 8 shows another embodiment of the present invention including a support or stabilizer arm 90, pivot mechanism 92, and stabilizer pad 94. The arm 90 includes spaced shoulders 95 for accommodating shafts 96 of pivot mechanism 92. The pivot mechanism 92 shown in FIG. 9 also includes orthogonally disposed shafts 97 which passes through accommodating holes in plates 99 and 100 of the stabilizer pad 94.

A stabilizer pad 94 may be in the form of a pyramid and includes one wall 102 having a resilient rubber pad 104 secured thereto. Another wall 105 has a triangular shaped flange 107 extending therefrom. Actually, two flanges 107 could be used. The connecting struts 99 and 100 connect between walls 102 and 105.

In the embodiment shown in FIGS. 8 and 9, if the arm 90 is moved to a different angle the flanges 95 simply rotate about shaft 96. By lifting the arm 90 the stabilizer pad 94 may be rotated about the shaft 97 from the position shown in FIG. 8 to a position wherein the resilient pad 94 is in the horizontal or downward position.

The embodiments shown in FIGS. 8 and 9 comprises just two earth engaging surfaces. Obviously, three or more earth engaging surfaces could be used with the different surfaces being in their engaging position by simple rotation of the pad about the shaft 97.

What is claimed is:

1. In combination with a support arm of an earthmoving apparatus, a stabilizer pad comprising a piece having a cut-out opening and alternate ground engaging surfaces including one which has resilient means associated therewith and another which is rigidly connected to said one surface, means pivotally supporting said piece to the arm spaced a distance from the end of the arm with the cut-out opening permitting revolution of the piece relative to the arm through substantially one half revolution, the end of said arm forming an extension from the pivot point, whereby in a first position of the piece the resilient means engages the ground with the arm end above the resilient means, and in a second position, substantially one half revolution from the first position, the extension is for engaging with softer ground with the other surface of the piece being maintained above the extension and forming a limiting means to limit ground penetration of the extension.

2. A combination as set forth in claim 1 including locking means for locking the piece in a fixed position relative to the arm in the second position of the pad.

3. A combination as set forth in claim 1 wherein said piece has a U-shape defining the cut-out opening.

4. A combination as set forth in claim 1 wherein said piece is substantially flat on said another side and it has flange means extending therefrom forming at least part of a means for securing the piece to the arm.

* * * * *